United States Patent [19]

Nowak

[11] Patent Number: 4,594,974

[45] Date of Patent: Jun. 17, 1986

[54] SWITCHING ARRANGEMENT FOR GLOW PLUGS OF A DIESEL INTERNAL COMBUSTION ENGINE

[75] Inventor: Dieter Nowak, Munich, Fed. Rep. of Germany

[73] Assignee: Bayerische Motoren Werke AG, Fed. Rep. of Germany

[21] Appl. No.: 734,753

[22] Filed: May 15, 1985

Related U.S. Application Data

[63] Continuation of Ser. No. 506,320, Jun. 21, 1983, abandoned.

[30] Foreign Application Priority Data

Jul. 1, 1982 [DE] Fed. Rep. of Germany ..... 3224587

[51] Int. Cl.[4] ..... F02N 17/00

[52] U.S. Cl. ..... 123/179 H; 123/145 A; 219/492; 219/511

[58] Field of Search ..... 123/179 H, 145 A; 219/492, 490, 497, 511

[56] References Cited

U.S. PATENT DOCUMENTS

| | | | |
|---|---|---|---|
| 4,137,885 | 2/1979 | Van Ostrom | 123/179 H |
| 4,177,785 | 12/1979 | Sundeen | 219/511 |
| 4,245,296 | 1/1981 | Small et al. | 219/492 |
| 4,307,689 | 12/1981 | Raeske et al. | 123/179 H |

FOREIGN PATENT DOCUMENTS

| | | | |
|---|---|---|---|
| 2743059 | 4/1979 | Fed. Rep. of Germany . | |
| 3007129 | 8/1980 | Fed. Rep. of Germany . | |
| 3118792 | 3/1982 | Fed. Rep. of Germany . | |
| 0008360 | 1/1982 | Japan | 123/145 A |
| 0574350 | 9/1977 | U.S.S.R. | 123/179 H |

OTHER PUBLICATIONS

"Design of a Fast Start Glow Plug Control System for Diesel Engines", by A. R. Sundeen, SAE, Inc., Mar., 1979, Congress & Exposition, Detriot, Mich.

*Primary Examiner*—Parshotam S. Lall

*Attorney, Agent, or Firm*—Craig & Burns

[57] ABSTRACT

So-called quick-start glow plugs which, at normal operating voltage, are continuously connected to the operating voltage, are to be operable also at higher operating voltages. In order to protect the glow plugs from being destroyed, a timing device for the intermittent activation of the glow plug becomes effective, this timing device being actuated by an operating voltage monitoring device.

3 Claims, 1 Drawing Figure

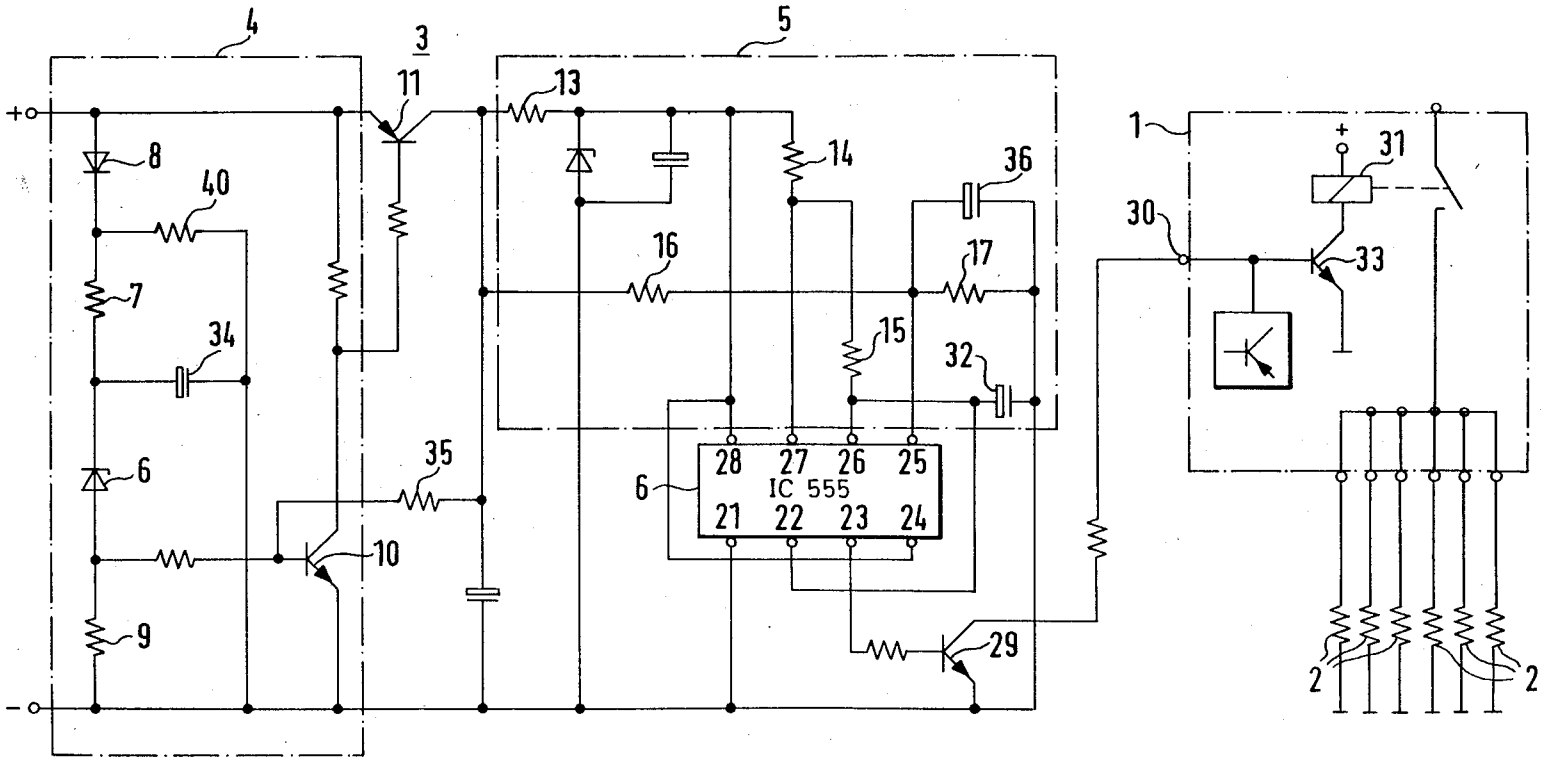
IC 555
1
2
3
4
5
6
7
8
9
10
11
13
14
15
16
17
29
30
31
32
33
34
35
36
40
+
-

SWITCHING ARRANGEMENT FOR GLOW PLUGS OF A DIESEL INTERNAL COMBUSTION ENGINE

This is a continuation of application Ser. No. 506,320, filed June 21, 1983, now abandoned.

The invention relates to a switching arrangement for glow plugs of a diesel internal combustion engine, these glow plugs being activatable at normal operating voltage for a relatively short period of time and in an uninterrupted fashion.

Such so-called quick-start glow plugs are increasingly utilized and make it possible on account of their high temperature and heat emission to considerably shorten the heating-up process as compared with the previously used, conventional glow plugs. The glow plugs are normally connected to the ordinary operating voltage of, in most cases, 12 V. It may be desirable to facilitate the starting process of the diesel internal combustion engine by increasing the operating voltage during this process so that it is, for example, twice as large as the normal operating voltage. If the glow plugs were to be exposed to this operating voltage without precautionary measures, the glow plugs would be destroyed within a short period of time.

The invention provides a single circuit for the use of glow plugs at an increased operating voltage without danger of damage or destruction. The preheating step furthermore is to take place at an accelerated pace.

The invention attains this in a switching arrangement of the type discussed above by providing an operating voltage monitoring device and a timing device activated by the latter for the intermittent actuation of the glow plugs at an operating voltage higher than the normal value.

By the timed actuation of the glow plugs, the latter are connected to the high operating voltage for only a short period of time. In the following inactivated phase, the glow plugs can cool off again. Thus, the glow plug never reaches a temperature presenting a danger to the plug.

It is known to activate glow plugs, providing a rapid execution of the preheating step, in a timed fashion at normal operating voltage. However, the associated switching arrangements are not designed for operating voltages which are substantially higher than the normal value.

An improvement of the invention resides in making the duration of activation per timing cycle dependent on the operating voltage. Thereby, the maximum glow plug temperature can be set to a predetermined, optimum value independently of the operating voltage.

The switching arrangement can contain a self-holding member maintaining the timing device activated during the entire preheating step, independently of the operating voltage. Thus, the timing operation is kept up even in case of fading of the voltage as it can occur, for example, when the starter motor is turned on.

Accordingly, it is an object of the invention to provide an improved switching arrangement for glow plugs of internal combustion engines. It is a further object of the invention to provide a switching arrangement for glow plugs such that the use of the glow plugs at increased operating voltage can be achieved without danger of damage or destruction to the glow plug.

It is another object of the invention to provide a switching arrangement for glow plugs wherein the preheating step takes place at an accelerated pace.

It is a further object of the invention to provide a switching arrangement for glow plugs wherein is provided an operating voltage monitoring device and a timing device activated by the operating voltage monitoring device for the intermittent actuation of the glow plugs at an operating voltage higher than the normal value.

It is a further object of the invention to provide a switching arrangement for glow plugs, the glow plugs being activatable at normal operating voltage for a relatively short period of time and in an uninterrupted fashion wherein is provided means for monitoring operating voltage and a timing means activated by the monitoring means for the intermittent actuation of the glow plugs at an operating voltage higher than the normal value.

It is a further object of the invention to provide a switching arrangement for glow plugs wherein means is provided for controlling the activating period per cycle dependent on the operating voltage.

It is a still further object of the invention to provide a switching arrangement for glow plugs wherein is provided a self-holding means for keeping a timing means of the switching arrangement activated during the entire pre-heating step independently of a short-time drop of operating voltage.

These and other objects, features, and advantages of the present invention will become more apparent from the following description when taken in connection with the accompanying drawing which shows, for the purposes of illustration only, one embodiment in accordance with the present invention, and wherein:

A timing device 3 is connected to precede a conventional control device 1 for glow plugs 2 of a diesel internal combustion engine, not shown. This timing device consists of an operating voltage identification section 4, a timing control section 5, and a timing member 6 as the actual timing generator.

The identification section of operating voltage monitoring device 4 comprises essentially a Zener diode 6' connected via a resistor 7 and a diode 8 to the operating voltage. Furthermore, a resistor 9 is connected between Zener diode 6' and ground. The voltage, dropping at resistor 9, operates a transistor 10. In this connection, the transistor 10 is to be conductive if the operating voltage is higher than the normal operating voltage and has, for example, a value of 20 V. In this case, the transistor 10 switches another transistor 11 at the input of the timing control section 5 into the conductive condition.

The timing control section 5 contains several resistors 13–17 which, in the manner illustrated, are series-connected and/or connected to inputs 25–28 of the conventional timing member 6, which is commercially available, one such device carrying the model number IC 555. One output 23 of the timing member 6 controls a transistor 29. This transistor is connected to the input 30 of the control device 1. Terminal 24 may be connected to terminal 28.

The ratio of the activating and deactivating pulses and pulse intervals supplied by the timing member 6 via the transistor 29 in inverted fashion to the input 30 of the control device 1 and being converted therein, with the aid of a load relay 31 controlled by a switching transistor 33, into activating and deactivating steps, is determined by the magnitudes of the resistors 14 and 15.

As long as the operating voltage has a normal value of, for example, 12 V, the voltage dropping at resistor 9 does not suffice for activating transistor 10. Thus, the timing control section 5 and the timing member 6 likewise are not actuated. The control device 1 then activates the glow plugs 2 with the aid of load relay 31 for a predetermined time of several seconds—until the preheating process is completed—and, during the subsequently occurring actual starting process of the internal combustion engine, in the usual way in a continuous fashion.

However, if the operating voltage is higher and has, for example, a value of 20 V, then transistor 10 and thus transistor 11 become activated. This activation, though, takes place with a time delay as regards the applying of the operating voltage. For this purpose, a capacitor 34 is connected in the identification section 4 in parallel with the Zener diode 6' and resistor 9. Only when this capacitor has been charged, via the resistor 7 and the diode 8, will the timing member 6 be activated via the timing control section 5. During this delay period, the transistor 29 is still blocked. Thereby the control device 1 can activate the glow plugs 2 for a short time, effecting a rapid heating up of the cold glow plugs.

With a repeated deactivation and activation of the glow plug installation, the time period by which the timing circuit responds becomes, depending on the interval, smaller or zero since the capacitor 34 must first be discharged via resistor 7 and a high-ohmic resistor 40. This prevents overheating of the glow plugs 2.

Once transistor 11 has become conductive, the timing control section 5 becomes effective. The timing member 6 now activates transistor 29 and, thereby in inverted fashion as previously described, the control device 1 with a pulse sequence. This pulse sequence causes the control device 1 to activate and deactivate the glow plugs 2 in synchronism. The activating and deactivating time and/or the pulse or interval time is determined, as described above, by resistors 14, 15 and a capacitor 32. In this connection, resistor 15 alone determines the activated period of the glow plugs 2 whereas their inactive period is determined by resistors 14 and 15 jointly, after the respectively preceding activation. The timing characteristic of the activation and inactivation process for the glow plugs 2 is provided by a capacitor 32 connected to the low voltage side of resistor 15 and connected between the outputs 21 (ground) and 22 of the timing member 6 as shown in the FIGURE. Furthermore, the pulse-interval ratio of the timing cycles is set by the operating voltage via resistors 16 and 17 and a capacitor 36 connected in parallel with resistor 17 in such a way that the glow plugs 2, independently of the actual operating voltage, are always heated up to approximately the same temperature.

Finally, a self-holding member in the form of a resistor 35 is inserted between the collector or transistor 11 and the base of transistor 10. Thereby, transistor 10 and thus also transistor 11 remain conductive even in case of a short-time drop of the (elevated) operating voltage so that also in this instance the timing control section 5 and the timing member 6 are effective. As a consequence, once transistor 10 has been rendered conductive, the timing operation for the glow plugs 2 is maintained.

While I have shown and described only one embodiment in accordance with the present invention, it is understood that the same is not limited thereto but is susceptible to numerous changes and modifications as known to one having ordinary skill in the art, and I therefore do not wish to be limited to the details shown and described herein, but intend to cover all such modifications as are encompassed by the scope of the appended claims.

I claim:

1. A switching arrangement for glow plugs of a diesel internal combustion engine, the glow plugs being activatable at normal operating voltage for a relatively short period of time and in an uninterrupted fashion, comprising means for monitoring operating voltage and timing means activated in a series of cycles by the monitoring means for the intermittent actuation of the glow plugs at an operating voltage higher than the normal value, a self-holding means for keeping the timing means activated during the entire preheating step, independently of a short-time drop of the operating voltage, wherein said means for monitoring operating voltage comprises means for producing a delayed input to activate said timing means in response to receipt by said means for monitoring operating voltage of an operating voltage higher than normal.

2. A switching arrangement according to claim 1, further comprising means for controlling the activating period of the timing means for each cycle in response to the operating voltage.

3. A switching arrangement for glow plugs in accordance with claim 1 wherein said timing means further comprises means for controlling the pulse-interval ratio of the timing cycles of the timing means set by the operating voltage to cause heating of the glow plugs to approximately the same temperature independently of actual operating voltage.

* * * * *